US005538065A

United States Patent [19]

Géraud

[11] Patent Number: 5,538,065

[45] Date of Patent: Jul. 23, 1996

[54] LIGHT-EXCLUSION COVERING, METHOD FOR ITS PRODUCTION AND A DEVICE FOR ACTUATION OF THE LIGHT-EXCLUSION COVERING

[76] Inventor: Otto A. Géraud, Köllikerstrasse 99, CH-5014 Gretzenbach, Switzerland

[21] Appl. No.: 232,254

[22] PCT Filed: Mar. 29, 1993

[86] PCT No.: PCT/CH93/00086

§ 371 Date: Oct. 24, 1994

§ 102(e) Date: Oct. 24, 1994

[87] PCT Pub. No.: WO94/12756

PCT Pub. Date: Jun. 9, 1994

[30] Foreign Application Priority Data

Nov. 27, 1992 [CH] Switzerland ..... 3643/92

[51] Int. Cl.[6] ..... A47H 1/00

[52] U.S. Cl. ..... 160/85; 160/120; 160/241

[58] Field of Search ..... 160/120, 122, 160/85, 86, 241

[56] References Cited

U.S. PATENT DOCUMENTS

| | | | |
|---|---|---|---|
| 2,140,049 | 12/1938 | Grauel | 160/85 X |
| 2,142,822 | 1/1939 | Moore | 160/120 |
| 2,384,377 | 9/1945 | Holstein . | |

FOREIGN PATENT DOCUMENTS

| | | | |
|---|---|---|---|
| 1354192 | 1/1964 | France . | |
| 1811271 | 7/1969 | Germany . | |
| 2358328 | 6/1975 | Germany . | |
| 3246075 | 6/1984 | Germany . | |
| 3309613 | 9/1984 | Germany . | |
| 8525625 | 10/1985 | Germany . | |
| 3536189 | 4/1987 | Germany . | |
| 503390 | 12/1954 | Italy | 160/86 |

*Primary Examiner*—Blair M. Johnson
*Attorney, Agent, or Firm*—Laurence R. Brown

[57] ABSTRACT

The light-exclusion covering is composed of two planar structures (1) located one behind the other, each of which consists of side by side webs (B) with regions (2; 3) of differing light transmissivity, that are connected to each other by connecting pieces (Z) with similarly selectable light transmissivity.

The planar structures (1) consist preferably of a woven textile fabric produced on a knitting machine with programmed data for sizing and for the light transmissivity of the individual regions. (FIGS. 1 and 2)

15 Claims, 3 Drawing Sheets

FIG. 4
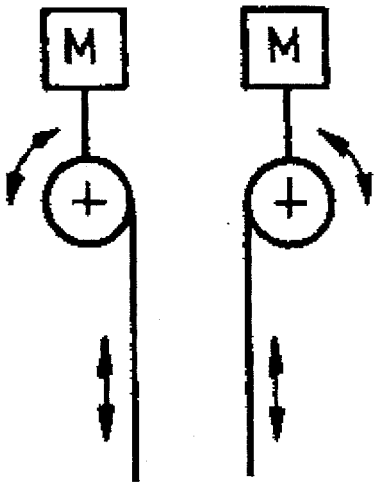
FIG. 5
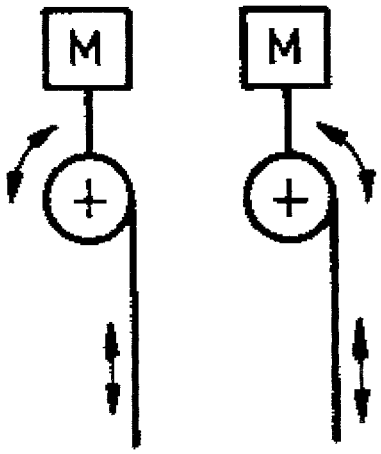
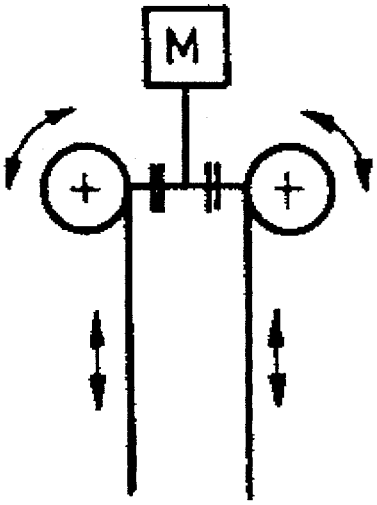
FIG. 6
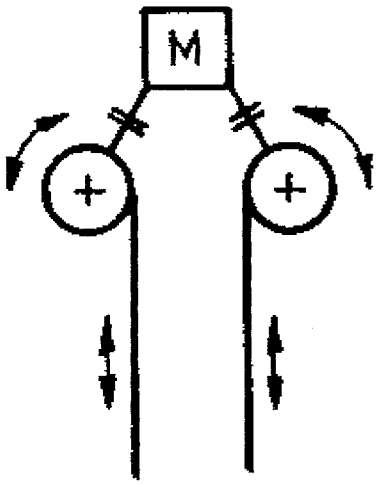
FIG. 7

FIG. 8
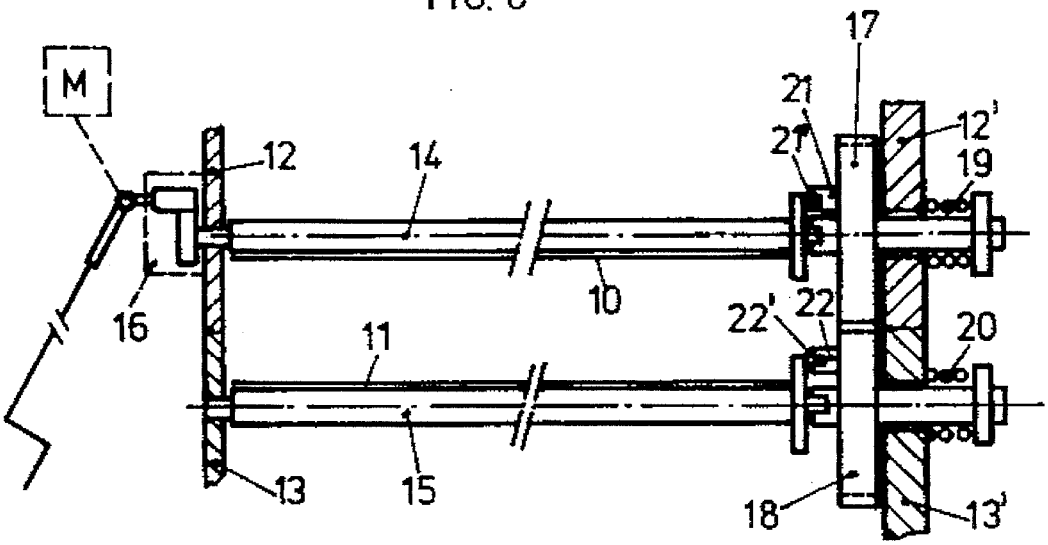
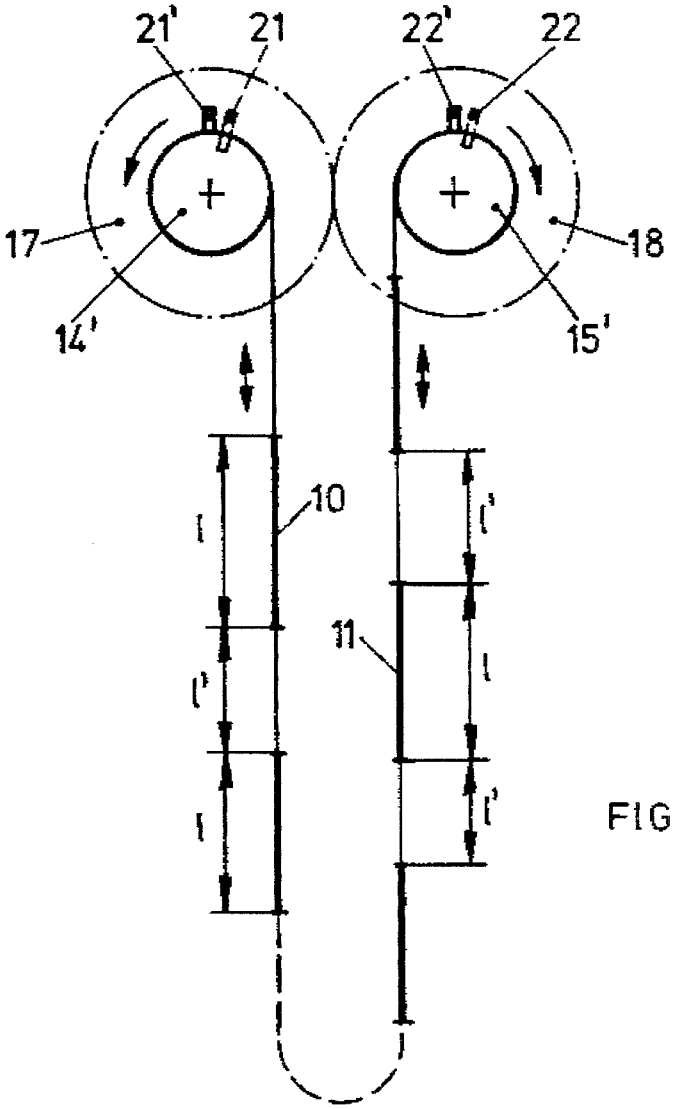
FIG. 9

LIGHT-EXCLUSION COVERING, METHOD FOR ITS PRODUCTION AND A DEVICE FOR ACTUATION OF THE LIGHT-EXCLUSION COVERING

The invention pertains to a light-exclusion covering for window surfaces, to a method for its production and to a rolling up or unrolling device for its actuation.

Light-exclusion coverings for window surfaces are known that consist of two planar structures located one behind the other that are vertically adjustable by rolling or unrolling devices, and with zones of differing light transmissivity of flexible material, in particular of woven textiles or fabrics. Coverings of this type consist, as a rule, of foils with bar-like zones of differing light transmissivity running across the entire width, whereby in particular the zones of lesser light transmissivity extend regularly across the entire width of the planar structure, so that a total light covering can be attained by even a small vertical adjustment.

Such constructions are not entirely satisfactory in practice, since the attainable adjustments of the region are greatly limited.

It is the problem of the invention to remedy this disadvantage.

This is achieved by this invention for a light-exclusion covering of the above-mentioned type, in that the planar structures consist of a number of webs located side by side, which are connected to each other across a connecting piece, where the connecting pieces feature a nearly uniform light transmissivity across their entire length, whereby the length of the regions of greater light transmissivity is smaller than the length of the regions of lesser light transmissivity.

Thanks to this particular design it is possible to find an optimum solution through appropriate and/or task-specific selection and/or sizing of the regions of differing light transmissivity of the individual webs and of the connecting pieces.

Preferably, the covering is designed so that the regions with differing light transmissivity have the same size and regions of equal light transmissivity are located across the width of the planar structure.

The production of the covering is particularly simple when it is made of a woven textile fabric.

The preparation of the light-exclusion covering according to this invention takes place preferably on a knitting machine, where the width, height and light transmissivity of the differing web regions and the width and light transmissivity of the connecting pieces are preselectable or preadjustable on the machine for a planar structure to be produced.

To operate the light-exclusion covering according to this invention, a rolling or unrolling device is proposed that is distinguishing in that a separate rolling roller is provided for each upper end of the two planar structures, whereby these rollers are located side by side, and in that drive features are provided for the rollers.

The drive features are composed of at least one motor or, if desired, of at least one manual crank drive, where separate and independent drive features can be provided for each roller.

One particularly simple design can consist in that common drive units can be provided for both rollers; said drive units can be connected optionally with one and/or the other roller by means of transmission and/or coupling devices.

Thanks to the two separate rollers, less installed height is needed (sufficient width is provided), which can be decisive in practice. In addition, much greater variation of light exclusion can be achieved than with conventional systems with only a single roller (in particular with two independent planar structures).

The invention will be explained in somewhat more detail below based on embodiments presented in the figures. We have:

FIGS. 4–7 show different variants of the drive features for the rolling and unrolling rollers, purely schematically; and FIGS. 8 and 9 show an additional design of a rolling and unrolling device according to this invention.

FIG. 1 shows the fundamental structure of a suitable planar structure 19 for formation of a light-exclusion covering. This planar structure consists of a number of webs $B_1$,$B_2$,$B_3$, etc., located side by side, that are connected together by connecting pieces $Z_1$,$Z_2$, etc.

Each web B features alternating regions 2 and 3 with differing light transmissivity, where the regions 2 have a lesser light transmissivity and regions 3 have a larger light transmissivity. Regions 3 with large light transmissivity can consist quite simply of open holes.

The connecting pieces connecting the webs B with each other likewise have a predetermined and/or selectable light transmissivity.

Furthermore, the widths b or b' of the webs B and/or of the connecting pieces Z and the lengths 1 and 1' of regions 2 and 3 with differing, selectable light transmissivity, are also selectable, where 1 is always greater than 1', so that a complete coverage by means of the region of lower light transmissivity is possible thanks to the two planar structures being located one behind the other.

Figure 2:
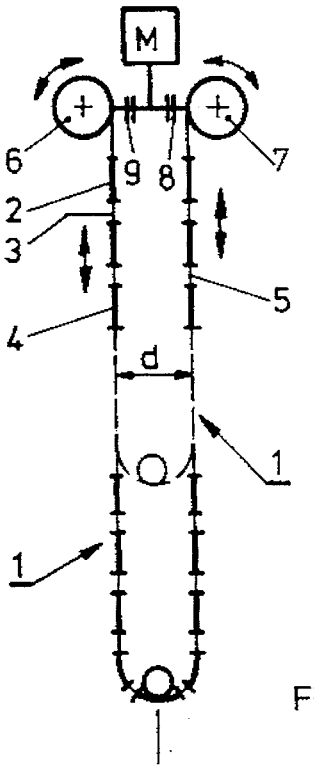
FIGS. 2 and 3 show mounted light-exclusion coverings with suspended and/or free planar structures and their drive features (purely schematically)
Figure 3:
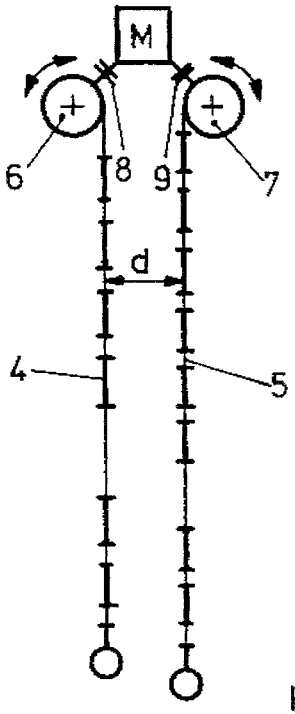

FIGS. 2 and 3 show how different degrees of coverage can be achieved by relative shifting (vertically) of the two planar structures 4,5. Naturally by lifting both planar structures, the lower section can be more or less completely exposed (free of coverage). It is also possible to raise or lower both planar structures at the same time and at the same speed once the coverage is adjusted, and thus to leave the degree of coverage in the region of the actual covering unchanged.

The planar structures themselves are produced preferably as textile fabric on a knitting machine, where all dimensions (b,b', 1,1') and the light transmissivity desired for the various regions (2,3,Z) are preselected and can be input as a program to control the knitting machine.

The particular feature about the rolling or unrolling device for actuation of the light-exclusion covering rests in the fact that two rollers 6,7 are used that can be driven individually. As drive unit at least one motor M is used (this motor M can of course be replaced by a manually operated crank drive). When using only one motor, suitable transmission and coupling devices 8,9 are located between this motor and the two rollers 6,7, so that an individual (or simultaneous) drive of the rollers 5,6 is possible with only one motor.

Different drive versions are illustrated schematically in FIGS. 4–7.

One of the advantages of the actuating device according to this invention rests in the fact that through the use of two separate rollers, the necessary installed height (and space requirements for the rolled light-exclusion covering) can be reduced significantly.

Furthermore, thanks to the individual drive for the rollers, it is possible to adjust the degree of coverage as desired, and thereafter by means of simultaneous driving of the two rollers, to raise the protective covering to the preselected setting, without thereafter a renewed setting being required.

Naturally the distance d between the two side by side planar structures 3,4 can be selected as desired (more or less closely together).

The simplest possible drive unit is desired in order to adjust the one planar structure relative to the other (for adjustment of the light covering), where the adjusting path should amount to a maximum 1+1' (thus all possible coverage settings are adjustable), and in order to roll the two planar structures up or down on both winding tubes roughly uniformly.

In each of the intermediate rolled or unrolled settings, an adjustment of the light coverage should be possible.

During rolling up, both rolling tubes should pick up about the same length of planar structure (preferably uniform distribution so that the space requirement for the rolling and unrolling device can be kept to a minimum).

To solve this complex problem a surprisingly simple design was found that requires only the direct actuation of one of the two winding tubes. This solution is presented in FIGS. 8 and 9.

The device operates essentially regardless of whether the two planar structures are designed as separate or interconnected webs.

As FIGS. 8 and 9 show, the rolling and unrolling device for adjusting one of two planar webs 10,11 (designed, e.g., according to FIG. 1) with zones of differing light transmissivity, features two winding tubes 14,15 for the planar structures 10 and 11 seated in end plates 12,12' and 13,13' respectively. Regardless of whether the web structures 10,11 form separate webs (perhaps with weights at their lower free ends) or are made of one piece, each tube 14,15 should roll up about equal lengths of the planar structure.

Merely the one winding tube 14 will be driven from the outside for adjusting the light-exclusion covering and for their winding up or unrolling from the tubes 14,15 (by means of motor M or a hand crank with smaller transmission 16). The tubes 14,15 are otherwise free to rotate.

At the end opposite the drive unit the tubes 14,15 are seated indirectly in the plate 12',13'. This mounting takes place by means of two adjustable, cogwheels 17,18, that engage each other and are in turn mounted in the plate 12',13' (preferably by means of spring elements 19,20 with their side surfaces pressed against the plate, to be decelerated in this way).

The cogwheels 17,18 feature a laterally protruding cam or pin 21 or 22 that rotates at a specified radius around the axis of the cogwheel and thus runs up to a tang 21' or 22' at the tubes 14,15 and/or end flanges 14',15' of these tubes (see FIG. 9).

Now if the tube 14 is rotated by means of its drive unit (0°–about 360°), only the tube 14 will be rotated by this angle, but not the associated cogwheel 17 and thus also not the cog wheel 18 and thus the second tube 15. In this manner it is possible to adjust only the one web 10 with respect to web 11, which corresponds to the setting of the light-exclusion covering.

Figure 1:
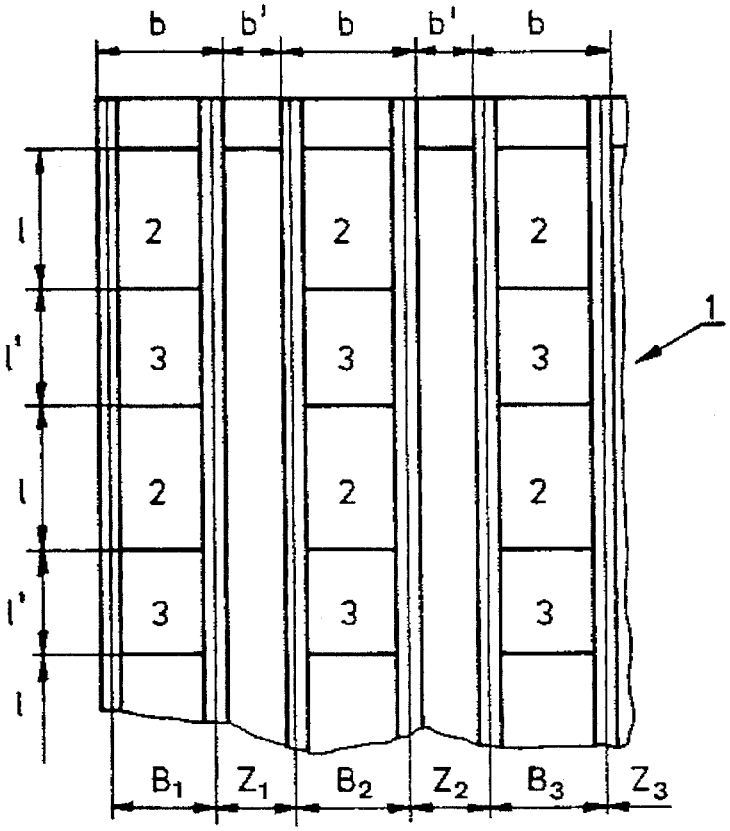
FIG. 1 shows a purely schematic view of a planar structure according to this invention.

The most expedient maximum adjusted value in this case amounts to 1,1' (see FIG. 1). If this adjusted path corresponds to the perimeter length (about 360°) of the cam or pin 21 or 21', then no additional measures need be taken. After execution of a tube rotation, the cogwheel 17 will automatically be rotated and thus also the second cogwheel 18 and the tube 15 coupled with it, which leads to simultaneous rolling up or unrolling of the two webs 10,11.

However, if the rotational length of the tang 21 happens to be smaller than 1+1' (but at a minimum half of 1+1'), then twice the length can be attained by the corresponding configuration between tube 15 and cogwheel 18. In this case tube 15 must also rotate freely about the cogwheel 18 (so that relative rotation by about 360° is possible).

It may be necessary to operate the device first briefly (maximum two tube rotations) in order to set the optimum starting position (the first cogwheel 17 will be set in rotation no later than after one tube rotation, whereas the likewise rotating cogwheel 18 will begin to rotate the associated tube 15 no later than after one rotation of the cogwheel 18).

Thanks to the device described above, using a simple design (a drive crank and/or a drive motor) any desired light-exclusion coverage can be achieved with the webs partly or entirely rolled up or down.

The cogwheel 17,18 are preferably braked so that they cannot by themselves slip by a single rotation (due to the weight of the webs). The settings or adjustments can also be implemented without such brakes, but this presumes a certain skill on the part of the operator.

The illustrated design has proven to be particularly favorable. Quite naturally the drive between tubes and cogwheel could be implemented differently (although probably more complicatedly), e.g., by means of an intermediate transmission with tangs located in a suitable manner, that would permit the cog wheel 17,18 to be located outside the tube axes.

I claim:

1. Light-exclusion covering system for window surfaces, comprising in combination, two planar web sections of flexible material located one behind the other having regions of differing light transmissivity, roller means mounted and connected to the web sections for relatively vertically moving the web sections, said web sections comprising a number of vertically disposed pieces of respective predetermined lengths located side by side presenting alternating pieces of differing light transmissivity, one set of alternating pieces producing, a nearly uniform light transmissivity along the lengths, thereof and another set of alternating pieces having disposed along their length shorter member of said regions of greater light transmissivity and longer member of said regions of lesser light transmissivity.

2. The system of claim 1 wherein the planar web sections further comprise a knit fabric.

3. The system of claim 2 wherein the knit fabric further comprise a plurality of panels of different light transmissivity connected together in said planar sections.

4. The system of claim 3 further comprising open holes in the knit fabric sections providing regions of greater light transmissibility.

5. Light-exclusion covering system according to claim 1, characterized in that the regions of the webs of greater light transmissivity are formed by open gaps.

6. Light-exclusion covering system according to claim 1, characterized in that the regions of greater and lesser light transmissivity are of the same sizes and regions of equal light transmissivity are adapted to be disposed at similar vertical positions along the web sections.

7. Light-exclusion covering system according to claim 1, characterized in that the two planar web sections located one behind the other are connected to each other at their lower ends forming a unitary web adjustable by rolling.

8. Light-exclusion covering system according to claim 1, characterized in that the planar structure is a woven textile.

9. A light-exclusion covering system according to claim 1, wherein said roller means further comprises a separate roller connected to each of the two planar web sections, and means for mounting the separate rollers side by side above the planar web sections.

10. A system according to claim 1, further comprising roller drive means connected to only one roller, and conditional rotating means coupling the two rollers for rotation of the second roller in response to the roller drive means after rotation of the first roller over an angle not exceeding 360 degrees.

11. A system according to claim 1, wherein the roller means further comprise separate, independent drive units for each roller.

12. A system according to claim 1, wherein the roller means further comprises two rollers with a common drive provided for rotating both rollers; said common drive means comprising transmission means coupling the drive means to the two rollers.

13. A system according to claim 1, wherein the drive means is mounted in a housing and comprises two interengaged two cogwheels pressed frictionally by spring force to bear against the housing.

14. In a light exclusion device for window surfaces comprising two planar web sections located one behind the other with zones of differing light transmissivity positioned for variably excluding light when the web sections are relatively vertically moved by a suitable drive mechanism for rotating two separate rollers coupled to the respective web sections at upper ends, the improvement comprising in combination:

means for mounting said two separate rollers side by side, rotating means coupled to a first of said two rollers, separate cogwheels located in said mounting means for the respective rollers coupled to conditionally move both rollers together in response to the rotating means, and conditional engaging means disposed between the two rollers and the respective cogwheels for engaging the two cogwheels for rotating the second of said two rollers after rotation of the first roller by the rotating means over a predetermined rotation not exceeding 360 degrees.

15. The device of claim 14 further comprising decelerating means comprising springs axially urging said cogwheels to frictionally engage said mounting means.

* * * * *